United States Patent [19]

Schaus

[11] 4,266,513

[45] May 12, 1981

[54] FLUE HEAT EXCHANGER

[75] Inventor: Orland O. Schaus, Agincourt, Canada

[73] Assignee: Canadian Gas Research Institute, Don Mills, Canada

[21] Appl. No.: 68,132

[22] Filed: Aug. 20, 1979

[30] Foreign Application Priority Data

Sep. 1, 1978 [CA] Canada ..... 310568

[51] Int. Cl.[3] ..... F22B 7/00

[52] U.S. Cl. ..... 122/155 A; 110/323; 110/326; 122/44 A

[58] Field of Search ..... 110/322, 323, 326; 122/44 A, 155 A, 20 B; 431/170

[56] References Cited

U.S. PATENT DOCUMENTS

| | | | |
|---|---|---|---|
| 1,847,020 | 2/1932 | Parker et al. | 431/170 |
| 1,918,935 | 7/1933 | Sellers | 110/326 |

FOREIGN PATENT DOCUMENTS

| | | | |
|---|---|---|---|
| 473355 | 1/1951 | Canada | 110/323 |

*Primary Examiner*—Edward G. Favors

*Attorney, Agent, or Firm*—Arne I. Fors; Robert F. Delbridge

[57] ABSTRACT

A flue heat exchanger particularly adapted for use in a water heater tank comprising a plurality of segments of a metallic or non-metallic non-friable refractory material randomly packed within a flue. Rounded metallic sections of steel pipe or copper tubing having a length not less than one-half and not more than twice the diameter of said pipe or tubing are preferred.

13 Claims, 4 Drawing Figures

FLUE HEAT EXCHANGER

This invention relates to heat exchangers and, in particular, is directed to an improved heat exchanger for use in water heaters.

Conventional water heaters have a vertical flue of about 3-inch diameter passing centrally through a water tank. Water in the tank is heated by the hot combustion products of natural gas, propane or fuel oil passing from a combustion chamber or fire-box through the tank flue to a chimney. Heating efficiency, as determined according to Specification No. CAN 1-4.1 77 of the National Canadian Gas Association Standard, has been found to be about 70%. Considerable valuable heat is lost during the heating period and, in addition, heat values are lost during the burner-off period by normal operation of a burner pilot light.

It is a principal object of the present invention to provide an improved hot water heater having a heater flue which permits improved heat transfer from heating gases to contents of the heater tank.

Another object of the present invention is the provision of a novel flue system which is simple in construction, reliable and trouble free in operation, and which can be readily adapted to water heater and boiler systems.

The structure of our invention for use as a heat exchanger in a heater flue comprises, in combination, a plurality of segments of metallic or non-metallic, non-friable, refractory material randomly packed within said flue to fill at least a portion of said flue to form a gas permeable packing.

More preferably, my invention contemplates the use of a plurality of rounded metallic sections having a length not more than twice the diameter of said sections randomly packed within said flue whereby heating gases flowing through said flue are distributed substantially evenly across the flue diameter for the length of the flue packed with said sections.

The apparatus of our invention finds particular utility in combination with a water heater tank having an open ended flue extending therethrough, said flue adapted to receive hot combustion gases for heating said tank, and comprises suspension means adapted to be supported in said flue and a plurality of sections of said rounded metal tubing supported by said suspension means randomly packed within said flue.

The structure of the present invention will become apparent from the following detailed description of the drawing, in which.

Like reference characters refer to like parts throughout the description of the drawings.

Figure 1:
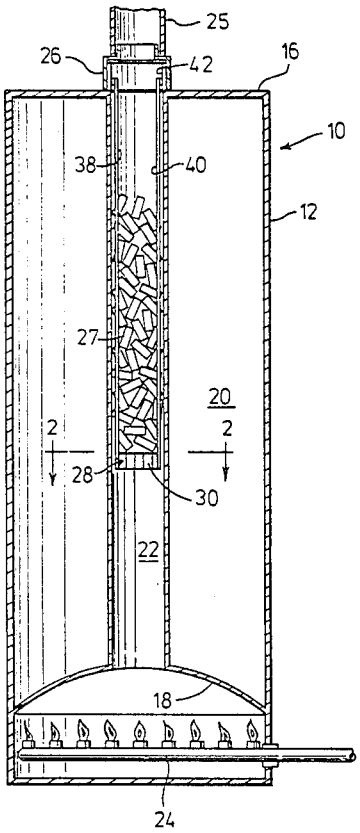
FIG. 1 is a vertical section of an embodiment of the invention.

With reference now to the drawings, hot water tank 10 comprises an outer cylindrical wall 12 and inner wall 14 disposed concentric with outer wall 12 and joined thereto by upper closure wall 16 and lower closure wall 18 defining annular chamber 20 therebetween.

Central opening 22 formed by wall 14 defining an open ended flue is in communication with a fire-box designated by numeral 24 from which hot combustion products from the burning of natrual gas, propane, fuel oil, and the like fuels are discharged for egress through flue 22 which is connected, at its upper end, with a vent 25 by means of draft hood 26.

Flue 22 is partially filled with a plurality of randomly packed uniformly-shaped segments of metallic or non-metallic, non-friable refractory material which, although permeable to the flow of gases therethrough, will interact collectively to provide tortuous paths which will somewhat impede the gas flow for reasons which will become apparent as the description proceeds. Rounded sections 27 of cylindrical metallic tubing, preferably sections of steel pipe or copper tubing about $\frac{3}{4}$ to 2" in length and $\frac{3}{4}$ to about $1\frac{1}{4}$" in diameter, are preferred. The rounded metal sections can additionally be formed of TM "glitsch" rings of dimensions similar to the aforesaid pipe sections having tabs punched out of the tubing wall to form fingers that protrude into the center of the ring.

The shape, dimensions, length to diameter relationship and metal of the tubular sections are important in providing desired function and durability to the structure. The shape of the sectional elements is important such that when the sections are randomly packed within a flue opening, the individual sections do not have flat surfaces which may abut and contact adjacent sections to block the passage of heating gases through the flue. A rounded, i.e. circular or elliptical, cross-sectional shape is preferred.

It will be understood that the dimensions of the metallic tubular sections may vary dependent on the flue diameter. However, it is important that the said dimensions relative to the flue diameter permit the sections to be randomly packed for the desired heat transfer, to be discussed hereinbelow, without alignment of the sections. The wall thickness of the tubing has no appreciable effect on heat exchange efficiency and sections of thin wall thickness thus are preferred to reduce the weight and thermal mass of the packing.

We have found that rounded sections having an average length more than twice the tubing diameter tend to pack in a parallel relationship with each other while sections having an average length less than one-half the tubing diameter tend to stack on edge on each other to close off and unduly obstruct the flow of gases through the flue. An average length to tubing diameter ratio within the range of 0.5:1 to 2:1 has been found satisfactory with a ratio of average length to diameter ratio of about 1:1 preferred.

Figure 3:
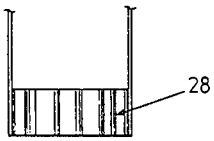
FIG. 3 is an enlarged vertical elevation of a component of the invention.

The rounded metallic sections 27 are supported by suspension means preferably comprising a base 28 formed of a plurality of sections 30 of metal tubing, usually of the same metal tubing from which sections 27 are formed, secured together such as by welding to define a honeycomb structure as shown most clearly in elevation in FIG. 3. Base 28 may have diametrically opposed flat sides 34,36 to receive a pair of spaced-apart thin steel straps 38,40 spot-welded or rivetted to frame 28 and extending upwardly for securement in like manner to a perforated or hollow disc 42 or the like spider frame which is seated on the upper wall 16 of tank 10 and which receives draft hood 26 in tight-fitting frictional engagement. Each of sections 30 has a diameter in the range of $\frac{3}{4}$ to $1\frac{1}{4}$" and a length in the range of 1 to $2\frac{1}{2}$".

Figure 2:
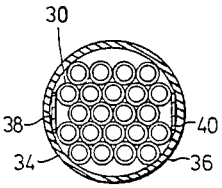
FIG. 2 is a transverse section taken along the line 2—2 of FIG. 1.

Alternatively, base 28 can be formed of a perforated disc having the same plan shape as shown in FIG. 2 with or without flattened sides 34,36 to receive straps 38,40.

Base 28 is located 6 to 12" from the bottom of the flue 22 to prevent flame impingement and carbon deposition thereon. A spacing of more than 12" has been found to promote the formation of condensate in the lower sections of the packing when heating a cold tank of water from 4°-17° C. to about 80° C. Localized overheating of the bottom of the water heater is also avoided which is beneficial for reduction of lime deposition.

Although it will be understood that we are not bound by hypothetical considerations, it is believed that the randomly packed hollow metallic sections distribute heating gases evenly across the flue cross-section to provide a uniform sectional temperature and improve radiant heat transfer relative to conventional flues. The presence of said metallic sections in the flue provides resistance to gas flow to retard the rate of gas flow thereby limiting the amount of excess air entrained by hot flue gases and increasing efficiency of combustion. The total volume of combustion products has been found to be considerably less than the volume flowing through the flue of a standard water heater under identical operating conditions thereby increasing retention time of heater gases in the flue. The tortuous path followed by the heating gases through the packing further increases retention time of the gases in the flue to enhance heat transfer from the gases to the tank contents.

Figure 4:
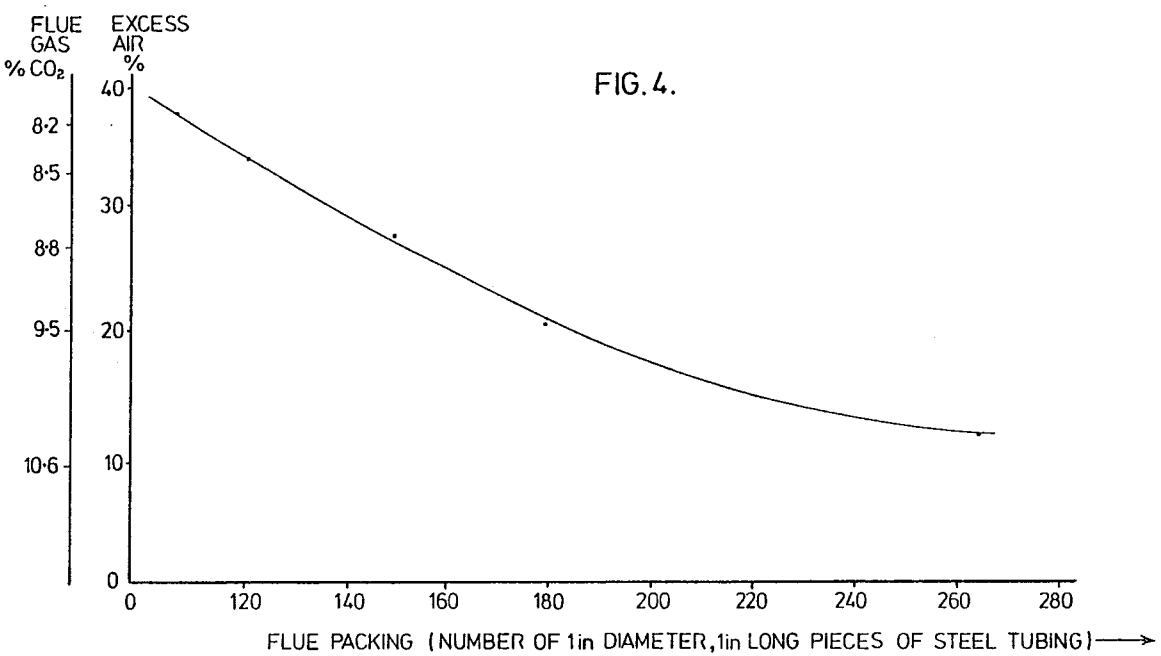
FIG. 4 is a graph illustrating the interrelationship between flue packing and quantities of $CO_2$ gas and excess air present in gaseous combustion products.

Maximum efficiency and minimum flue gas exit temperatures can be obtained by varying the number of sections of packing material. Different flue sizes will require different amounts of packing. The relationship between the length of flue packing, percentage of $CO_2$ and percent of excess air is shown in FIG. 4. It is apparent from this Figure that as the length of flue packing increases, proportional to the number of pieces of steel tubing, the quantity of excess air in the flue gas is reduced significantly, e.g. from about 40% to about 13%, while the efficiency of combustion is enhanced, e.g. $CO_2$ gas produced is increased from about 8% to about 10% for significant reductions in stack heat loss. The amount of packing used is, however, limited by the need to obtain sufficient flow through the flue system to prevent incomplete combustion and blowback of combustion products at the burner door. Heat absorbed by the matrix is radiated to the side walls of the wide centre flue.

Improved efficiency also results from an increase in heat exchanger surface area by increasing the flue diameter $4\frac{1}{2}$" or 6" compared to contemporary 3" diameter centre flue water heaters. The resistance of the packing restricts the passage of air through the flue during burner-off periods, thus reducing the standby losses.

Comparative tests were conducted between a water heater of the present invention, comprising a 33 Imperial gallon tank having a 6" diameter centre flue randomly packed for 22" of length with 1" diameter × 1" long light-weight steel tubing of the TM glitsch type supported 9.5" from the flue bottom on a base made of twenty-two $1\frac{3}{4}$" lengths of the same tubing welded vertically together as shown in the drawings, and a standard model water heater and a commercial "energy saving" model water heater each with 3" diameter flues. Results of the tests are shown in Table I below:

TABLE I

COMPARATIVE WATER HEATER PERFORMANCE

| | Standard Model | Commerical Energy Saving Model | CGRI Matrix Flue Model |
|---|---|---|---|
| Capacity (Imp. Gal.) | 33.3 | 33.3 | 33.3 |
| Input (M BTU/Hr.) | 40.0 | 32.5 | 33.5 |
| Insulation (Inches) | 1 | 2 | 2 |
| Thermal Efficiency | 70% | 77% | 85% |
| Degree Gallon Capacity | 82% | 72% | 83% |

It will be observed that the thermal efficiency of the water heater of the invention was 85% compared to 70% for the standard model and 77% for the commercial energy saving model.

The present invention provides a number of important advantages. Condensation in the flue due to uneven heat transfer which can produce localized areas of cooling with formation of moisture when the temperature drops below the dew point has been substantially avoided at flue gas exit temperatures as low as 150° C. The apparatus of our invention can be installed in existing flue systems with little structural modification and with a nominal increase in costs over that of conventional heaters for a limited increase in efficiency. Thermal efficiency of our system with wide diameter flue over conventional heaters is increased about 20% and vertical temperature gradients are reduced to yield more uniform water temperatures in the heater tank.

What I claim as new and desire to protect by Letters Patent of the United States is:

1. A heat exchanger for use in a flue comprising, in combination, a plurality of tubular metallic refractory sections having an average length to diameter ratio within the range of 0.5:1 to 2:1 randomly packed within said flue to fill at least a portion of said flue to form a gas-permeable packing whereby heating gases flowing through said flue are distributed evently across the flue diameter for the length of the flue packed with said sections.

2. A heat exchanger as claimed in claim 1, in which said tubular metallic sections have an average length to diameter ratio of about 1:1.

3. A heat exchanger as claimed in claim 1, in which said tubular metallic sections are circular or elliptical in cross-section and have a thin wall thickness.

4. A heat exchanger as claimed in claim 1, in which said tubular metallic sections are formed from cylindrical steel or stainless steel pipe or copper tubing about $\frac{3}{4}$ to 2" in length and about $\frac{3}{4}$" to $1\frac{1}{4}$" in diameter.

5. A heat exchanger as claimed in claim 1 additionally comprising suspension means for supporting said metallic sections in a vertical flue, said suspension means including a circular frame formed of a plurality of juxtaposed sections of metal tubing secured together and arranged parallel with each other and with the longitudinal axis of the flue to extend across the flue to substantially fill the cross-section of the flue, and supportive means for anchoring said frame within the flue.

6. A heat exchanger as claimed in claim 5 in which said anchoring means comprise a pair of straps connected to the frame and adapted to be connected to the top of the flue.

7. An improved water heater comprising, in combination, a water heater tank having an open ended flue extending therethrough, said flue adapted to receive hot combustion gases for heating said tank, suspension means adapted to be supported in said flue, and a plurality of tubular metallic refractory sections having an average length to diameter ratio within the range of 0.5:1 to 2:1 randomly packed within said flue to fill at least a portion of said flue to form a gas-permeable packing supported by said suspension means whereby heating gases flowing through said flue are distributed evenly across the flue diameter for the length of the flue packed with said sections.

8. A water heater claimed in claim 7 in which said flue is cylindrical in shape and is vertically disposed having top and bottom ends, and said suspension means comprise a substantially circular frame having a diameter slightly less than the diameter of the cylindrical flue, a pair of support straps are secured to diametrically opposed sides of said frame for supporting said frame within the flue, and means for anchoring said straps are supported at the top of the flue, whereby said tubular metallic sections are carried by the frame.

9. A water heater as claimed in claim 8 in which said anchoring means comprise a perforated disc seated on the tank at the top of the flue to which said straps are secured.

10. A water heater as claimed in claim 7 in which said frame comprises a bundle of juxtaposed sections of metallic tubing secured together and arranged parallel with each other and with the longitudinal axis of the flue opening, said bundle of metal tubing extending substantially across the flue opening to fill said flue opening.

11. A water heater as claimed in claim 10, in which said suspension means is supported a predetermined distance from the bottom of the flue.

12. A water heater as claimed in claim 8 in which said frame is located within the flue at least about 9″ from the bottom of the said flue.

13. A water heater as claimed in claim 8 in which said flue has a diameter of about 6″, said tubular metallic sections consist of $\frac{7}{8}$″ diameter steel tubing having 1″ length and said suspension means comprises a bundle of $\frac{7}{8}$″ diameter steel tubing having a length of about $1\frac{3}{4}$″ welded together parallel to each other and to the longitudinal axis of the flue.

* * * * *